US009089186B1

(12) United States Patent
McCloskey

(10) Patent No.: US 9,089,186 B1
(45) Date of Patent: Jul. 28, 2015

(54) BUTTON RESTRAINT SYSTEM AND METHOD THEREOF

(71) Applicant: Susan McCloskey, Jamestown, PA (US)

(72) Inventor: Susan McCloskey, Jamestown, PA (US)

( * ) Notice: Subject to any disclaimer, the term of this patent is extended or adjusted under 35 U.S.C. 154(b) by 119 days.

(21) Appl. No.: 14/065,987

(22) Filed: Oct. 29, 2013

Related U.S. Application Data

(60) Provisional application No. 61/831,295, filed on Jun. 5, 2013.

(51) Int. Cl.

| | |
|---|---|
| ***A44B 1/18*** | (2006.01) |
| ***D05B 91/00*** | (2006.01) |
| ***D05B 97/10*** | (2006.01) |
| ***A41H 37/10*** | (2006.01) |
| ***D05B 85/02*** | (2006.01) |

(52) U.S. Cl.
CPC *A44B 1/18* (2013.01); *A41H 37/10* (2013.01); *D05B 85/02* (2013.01); *D05B 91/00* (2013.01); *D05B 97/10* (2013.01); *A44B 1/185* (2013.01); *Y10T 24/36* (2015.01); *Y10T 24/3689* (2015.01)

(58) Field of Classification Search
CPC ..... A44B 1/185; A44B 17/0005; A44B 1/18; A44B 1/44; A41H 37/005; A41H 37/008; A41H 37/10; B68G 7/08; D05B 91/00; D05B 97/10; D05B 85/02; Y10T 24/3689; Y10T 24/36
USPC ..... 24/90.1, 114.3, 114.7, 114.8
See application file for complete search history.

(56) References Cited

U.S. PATENT DOCUMENTS

| | | | | |
|---|---|---|---|---|
| 1,771,822 | A * | 7/1930 | Soans | 5/696 |
| 2,605,943 | A * | 8/1952 | Hoefle | 223/102 |
| 3,785,009 | A | 1/1974 | Nysten | |
| 3,795,948 | A * | 3/1974 | Kapitan | 24/114.7 |
| 3,816,881 | A | 6/1974 | Van Riper, Jr. | |
| 3,829,935 | A * | 8/1974 | Critchfield | 24/114.3 |
| 3,900,925 | A * | 8/1975 | La Torraca | 24/90.1 |
| 4,043,006 | A * | 8/1977 | Williams et al. | 24/114.8 |
| 4,063,312 | A | 12/1977 | Braillard | |
| 4,111,341 | A * | 9/1978 | Carrozo | 223/106 |
| RE30,701 | E * | 8/1981 | Williams et al. | 24/114.8 |
| 4,296,698 | A | 10/1981 | Davidson et al. | |
| 4,316,562 | A | 2/1982 | Davidson et al. | |
| 4,333,182 | A * | 6/1982 | Seibt | 2/265 |
| 4,361,101 | A * | 11/1982 | Marsh et al. | 112/110 |
| 4,480,357 | A | 11/1984 | Cummins | |
| 5,695,505 | A * | 12/1997 | Yoon | 606/157 |
| D487,483 | S * | 3/2004 | Chen | D20/19 |
| 6,702,162 | B1 * | 3/2004 | Hassid | 223/1 |
| 2006/0249169 | A1 * | 11/2006 | Lee | 132/102 |
| 2008/0177302 | A1 * | 7/2008 | Shurnas | 606/228 |
| 2008/0195148 | A1 * | 8/2008 | Cook et al. | 606/232 |

(Continued)

FOREIGN PATENT DOCUMENTS

EP 0349721 1/1990

*Primary Examiner* — Robert J Sandy
*Assistant Examiner* — David Upchurch
(74) *Attorney, Agent, or Firm* — Montgomery Patent & Design; Robert C. Montgomery

(57) ABSTRACT

A button restraint system involves a backing clip, an elastic band, and a specialty needle device and further describes a method of use thereof. The needle is used to route and secure the band through a fabric garment and through aperture portions of a button. The band is then secured to the backing clip to hold the button against the fabric. The system obviates the need for a conventional needle and thread to attach the button.

15 Claims, 5 Drawing Sheets

(56) References Cited

U.S. PATENT DOCUMENTS

2010/0229772 A1* 9/2010 Turner ..... 112/224
2010/0230462 A1 9/2010 Lussier et al.
2012/0123541 A1* 5/2012 Albertorio et al. ..... 623/13.14
2012/0246881 A1 10/2012 Miyauchi et al.

* cited by examiner

BUTTON RESTRAINT SYSTEM AND METHOD THEREOF

RELATED APPLICATIONS

The present invention was first described in and claims the benefit of U.S. Provisional Application No. 61/831,295, filed Jun. 5, 2013, the entire disclosures of which are incorporated herein by reference.

FIELD OF THE INVENTION

The presently disclosed subject matter is directed to a device attachable to a dock piling particularly suited for protecting docking watercraft.

BACKGROUND OF THE INVENTION

There are a wide variety of attachment systems and methods used upon clothing such as zippers, snaps, hook and loop fasteners, and the like. But, perhaps the most common of these systems and methods are the ordinary button and button hole. The button has been used for countless generations for quickly and easily securing clothing. Unfortunately, it is also perhaps the most prone to failing by having buttons fall off of clothing. Detachment usually occurs at the most in opportune time when an article of clothing is needed the most. This forces a user to expend valuable time to either sew the button back on or find an alternate piece of clothing. Many people do not possess suitable seamstress skills, thus forcing a costly repair, or an even costlier replacement of the entire item of clothing. Accordingly, there exists a need for a means by which buttons can be replaced upon clothing in either a temporary or permanent fashion in order to increase its useful lifetime. The development of the present invention and Method Thereof fulfills this need.

Prior art in this field consists of needle and thread systems or button backing systems. Prior art needle and thread systems attempt to alleviate the burdens associated with threading the needle; however, they still rely on weaving a thread through a button and an article of fabric as the means of securement. Some prior art needle and thread systems require elaborate and expensive needles to achieve this goal. Most prior art button backing systems obviate the need of a needle and thread all-together; however, current button backings fail to provide much needed flexibility and movement for the button. Furthermore, most backings tend to be bulky and cumbersome. Additionally, button backing systems require special buttons. It is an object of this invention to provide a system and method of securing any style button in a quicker, easier, and more effective manner. It is a further object of this invention to incorporate the best aspects of a needle and thread system with a button backing system. It is a further object of this invention to provide a means to quickly and easily couple and de-couple the thread to the needle. It is a further object of this invention to provide a more flexible securement of the button with the backing so as to obviate failure due to constrained maneuverability, as exhibited by prior art systems and methods, but without compromising the integrity of the securement.

The disclosed system and method provides a means to attach buttons to a fabric without the traditional needle and thread approach, and may be used with almost any type of fabric or button type, including shank button styles, two-hole button styles, or four-hole button styles. The system utilizes a flexible band with a retaining clip that holds a button firmly against an article of fabric. After the button has been retained in place by the system, the button is subsequently used for a means of securement for multiple articles of fabric by being pushed through a button hole. The system provides for flexibility and movement greater than that achieved by prior art button restraining systems, techniques, and methods due to the flexible band.

When installing a button, the flexible band is first coupled to a specially designed needle. The special design enables a user to easily and removably couple the band to the needle as opposed to threading it through an eyelet portion of a needle, as is done with prior art needle and thread systems. After being coupled to the needle, the flexible band is received by the retaining clip. As the retaining clip is maintained at a stationary position at a rear face of the article of fabric, the band is threaded through a rear of the fabric. The band is then threaded through a button aperture of a button located at a front face of the fabric. It is then threaded back through a button aperture, and through a front face of the fabric. This process may be continued to provide a desired level of securement. The needle is then de-coupled from the band, where installation may be completed by fastening the retaining clip in place about the band. The various components of the system are available as a kit that comprises multiple bands, retaining clips, and at least one needle contained in a case.

SUMMARY OF THE INVENTION

The system provides a means to hold a button in place upon a surface of a fabric, which also includes a case to hold and transport all of the components of the system. The system utilizes a securement arrangement comprising an elastic band with a retention clip that not only holds the button against the fabric, but also provides added flexibility and movement within the securement. The securement arrangement is applied to an article of fabric via a specially designed needle having a generally "S"-shaped side slot portion to slidably accept the band. The needle, along with the coupled band, are threaded through an article of fabric and through button apertures to be retained in place with the retaining clip. The retaining clip has a clam-shell configuration to clamp around the band. After the band has been threaded through the article of fabric and the button, the band is removed from the "S"-shaped slot of the needle. If desired, the retaining clip is fastened in place about the band with the use of a fastener that enables repeated use of a clip. The system is preferably presented in a kit form, wherein a plurality of retaining clips, bands, and at least one needle are provided in a case. The case is a two-member unit, wherein a top member is hingedly attached to a bottom member. The case is configured to be durable and transportable.

In use, a first portion of a band is positioned within the clip, whereas a second portion of the band is slidably inserted into the slot portion of a needle. The needle and the band are then threaded through a rear side of an article of fabric until the clip abuts the rear side of the article. The needle and band are then threaded through at least one aperture of a button and back through the front face of the article. If desired, this process is repeated. Whether performed once or in iteration, both the clip and the button are snug against the front and rear faces of the article, respectively. The clip may then be fastened around the band if it is preferred. This method of securing the button is considerably quicker and easier than that of prior art methods and systems. Furthermore, the elastic band and clip securement configuration provides added flexibility and movement not achieved by prior art methods and systems.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
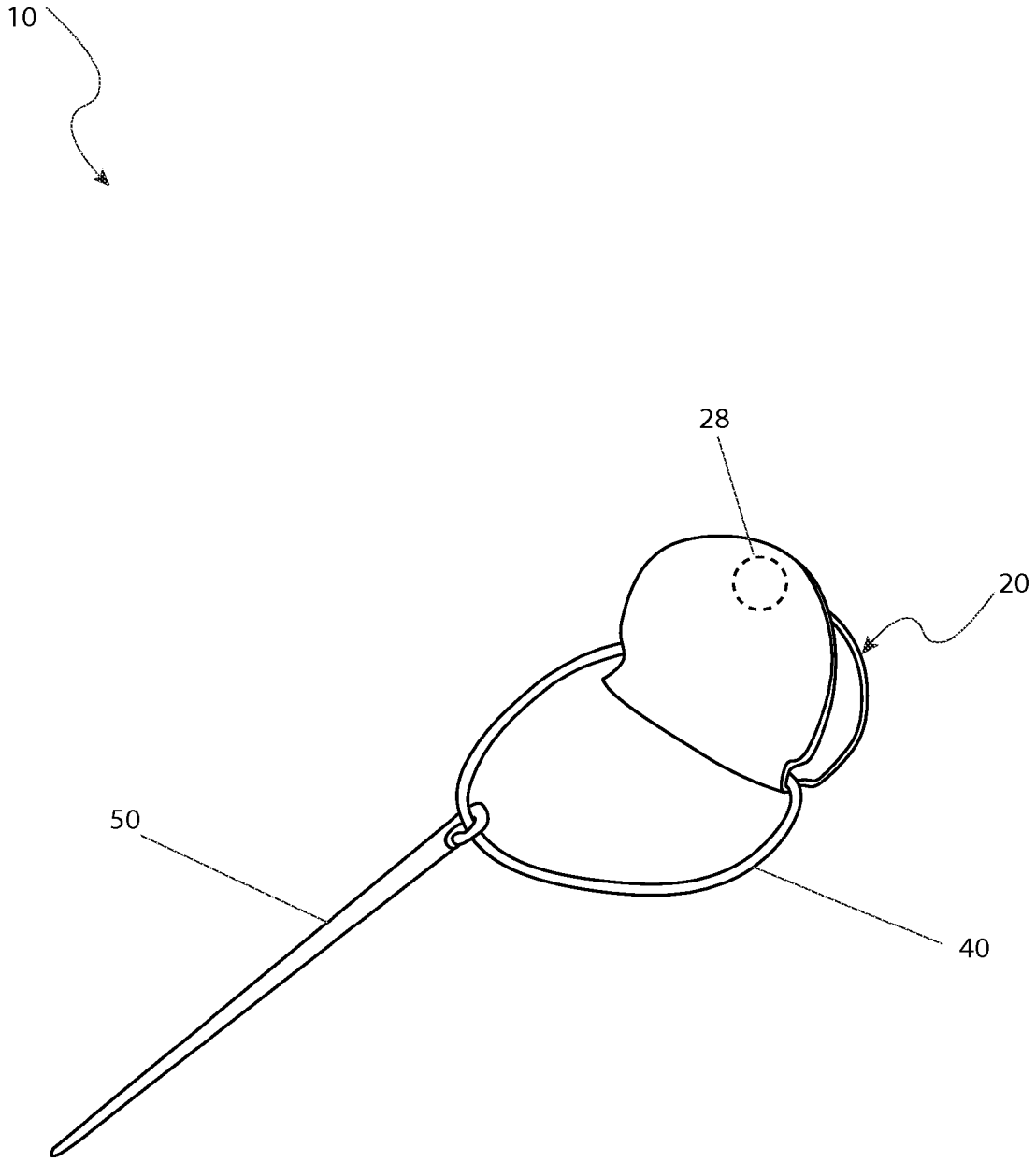
FIG. 1 is a perspective view of a button restraint system 10, according to a preferred embodiment of the present invention.

10 button restraint system
20 clip
22 first cover
24 second cover
26 first hinge
28 male fastener
30 female fastener
40 band
50 needle
52 side slot
60 case
62 compartment
64 lid
66 second hinge
68*a* first latching feature
68*b* second latching feature
100 button
102 aperture
105 fabric

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a button restraint system and method of use (herein described as the "system") 10, by which buttons 100 are attached to fabric 105 by substituting an elastic band 40 in place of a conventional threaded attachment.

Referring now to FIG. 1, a perspective view of the system 10, according to a preferred embodiment of the present invention, is disclosed. The system 10 operates without the traditional method of needle and thread, and also works with almost any type of fabric 105 or button types 100. Although illustrated here being utilized upon a common two-hole button 100, it is understood that the system 10 may work equally well on other button types such as shank style, four-hole, and others. The system 10 utilizes an elastic rubber or plastic band 40 that holds the button 100 firmly against the fabric 105, and allows for greater flexibility and movement when the button 100 is being subsequently pushed through a corresponding button hole. The flexible band 40 is attached to a specially designed needle 50 comprising a generally "S"-shaped side slot portion 52 which allows the continuous circular band 40 to be easily looped into and out of said side slot 52. The needle 50 is envisioned to be similar to commercially-available products distributed by the TELEBRANDS CORPORATION®. The needle 50 and attached band 40 pass through the fabric garment 105 and through aperture portions 102 of the button 100, being retained in position using a retaining clip 20 located beneath the fabric 105 (see FIGS. 2*a* and 2*b*).

Figure 2A:
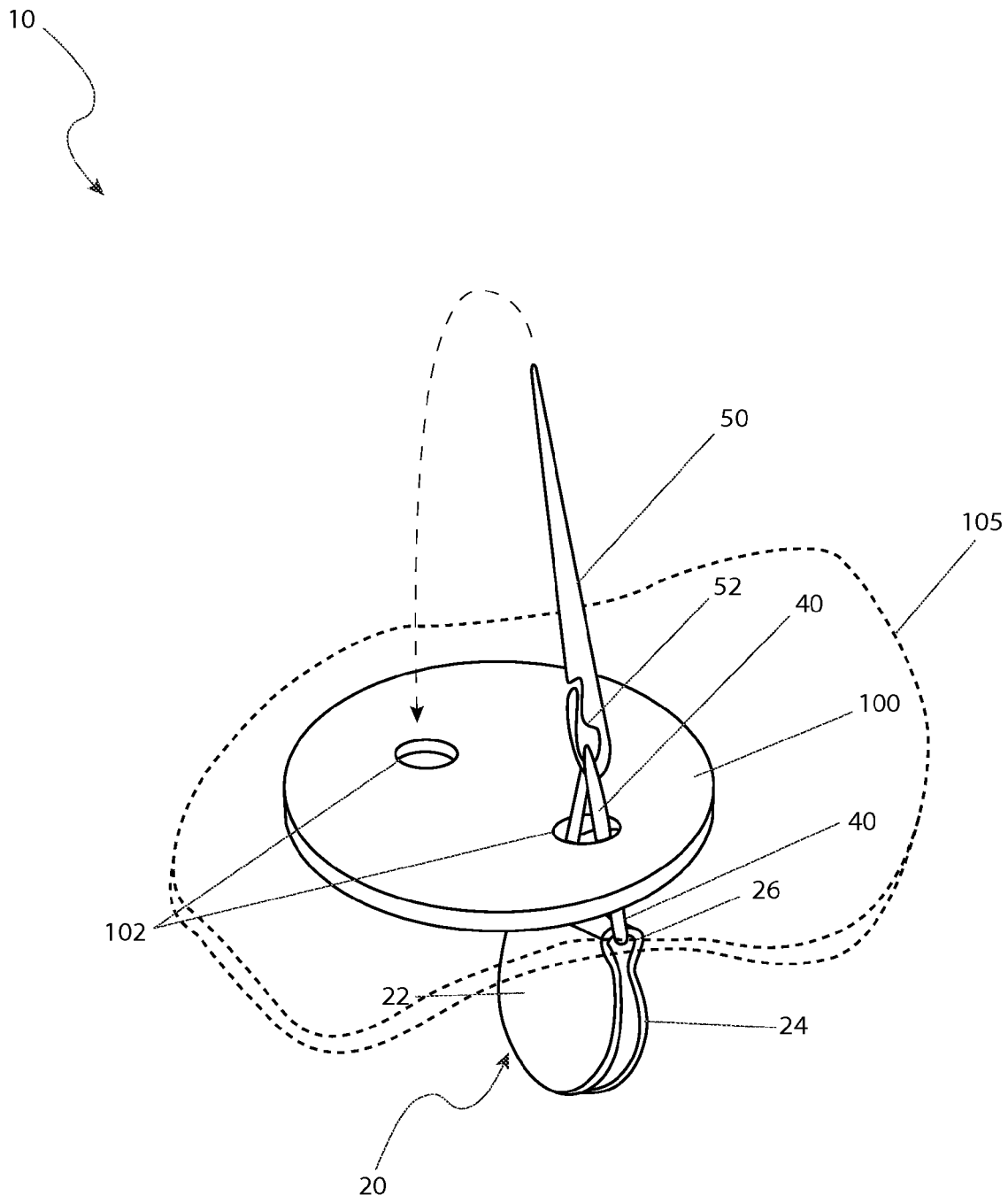
FIG. 2*a* is a perspective view of the button restraint system 10 depicting initial engagement of a needle portion 50 with a button 100, according to a preferred embodiment of the present invention.
Figure 2B:
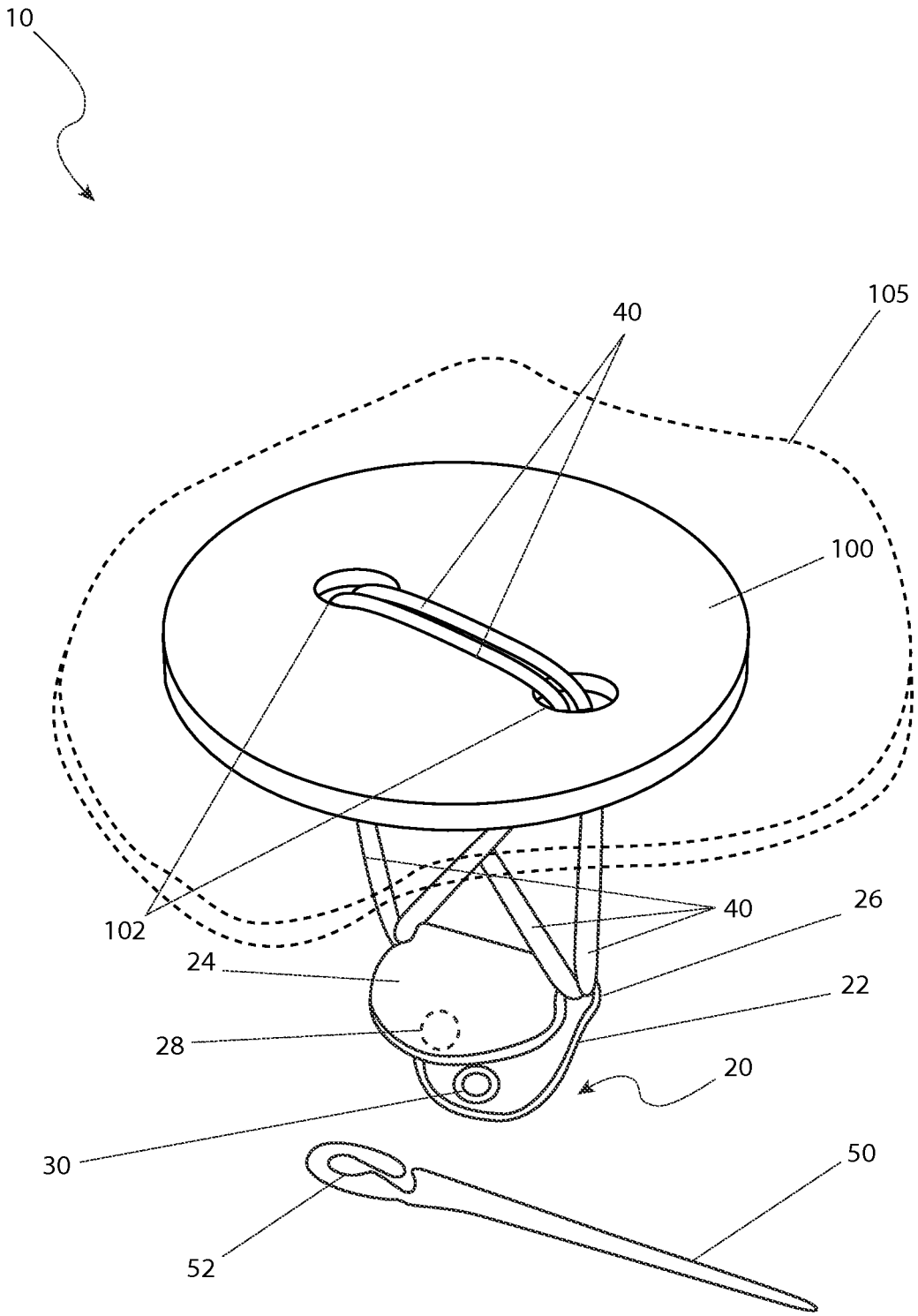
FIG. 2*b* is another perspective view of the button restraint system 10 depicting secondary engagement of the needle portion 50 with the button 100, according to a preferred embodiment of the present invention.

Referring now to FIGS. 2*a* and 2*b*, perspective views of the system 10 depicting sequential engagement of the needle portion 50 through the button 100, according to a preferred embodiment of the present invention, are disclosed. The clip 20 provides a locking clam-shell structure which clamps around the band 40 and is then snapped shut via a fastening means 28 (see FIG. 3). In use, one (1) portion of the band 40 is initially positioned within the clip 20, and an opposing portion is inserted into the side slot 52 of the needle 50. The needle 50 along with the attached band 40 then penetrate the fabric 105 and pass through an aperture portion 102 of the button 100. The needle 50 and attached band 40 are then re-inserted through another aperture 102 and through the fabric 105. The band 40 is secured within the clip 20 which is then fastened shut, and the band 40 is extracted from the side slot portion 52 of the needle 50 to complete the installation of the button 100. The system 10 is envisioned to be introduced in a kit format for convenient storage (see FIG. 4).

Figure 3:
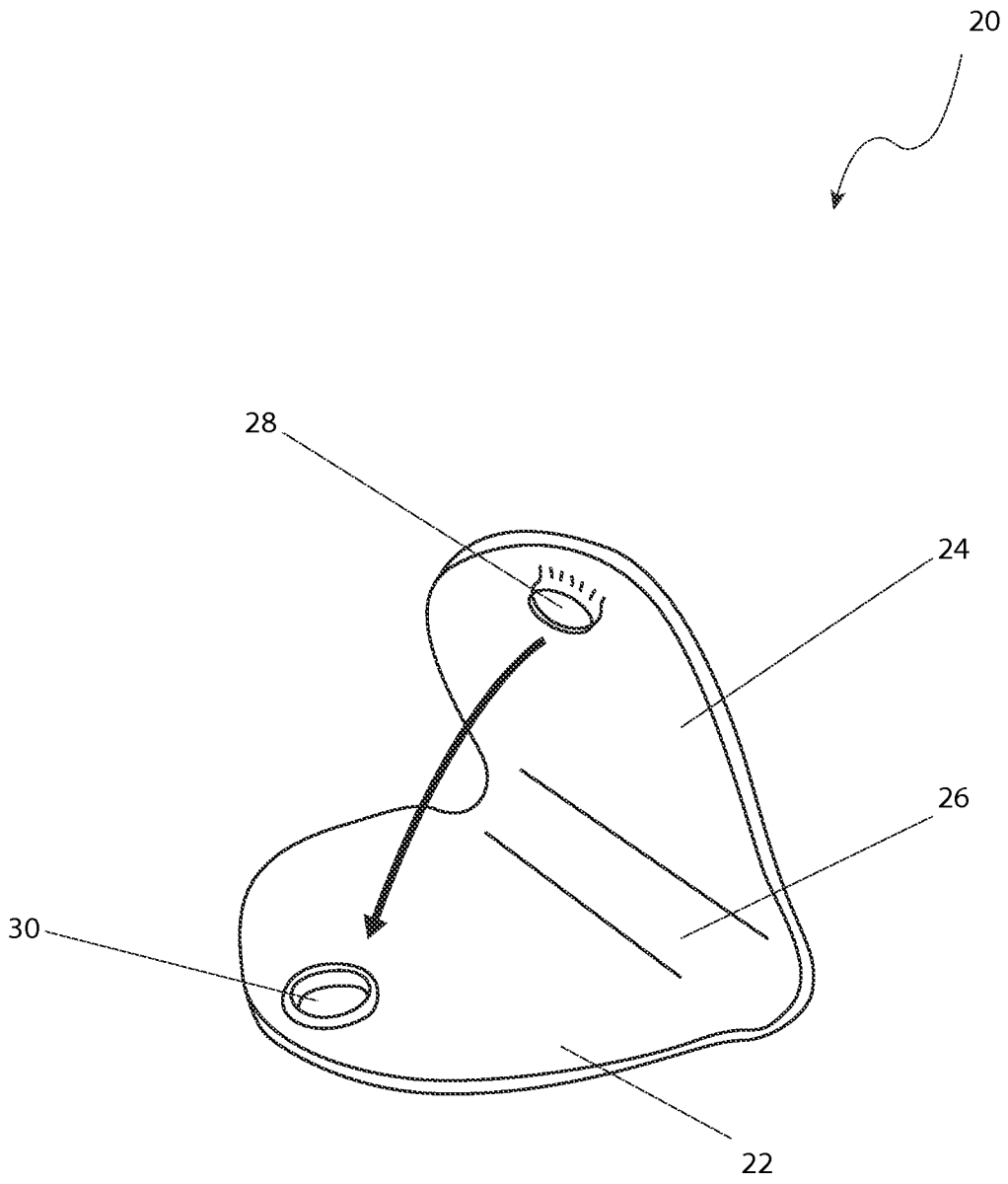
FIG. 3 is a perspective view of a clip portion 20 of the button restraint system 10, according to a preferred embodiment of the present invention; and, FIG. 4 is an exploded view of the button restraint system 10 depicting a case 60, according to a preferred embodiment of the present invention.

Referring now to FIG. 3, a perspective view of a clip portion 20 of the system 10, according to a preferred embodiment of the present invention, is disclosed. The clip 20 comprises a molded plastic closure further comprising semi-circular portions including a first cover 22, a second cover 24. The covers 22, 24 are joined by an integral tunnel-shaped first hinge 26 which provides clearance for the band 40 when inserted therein and the clip 20 closed. The first 22 and second 24 covers comprise respective integral male fastener 28 and female fastener 30 portions providing complimenting insertable spherical shapes which provide snapping and locking of the clip 20 in a closed state via an interference fit, thereby allowing repeated usage of said clip 20 if desired (see FIGS. 2*a* and 2*b*).

Figure 4:
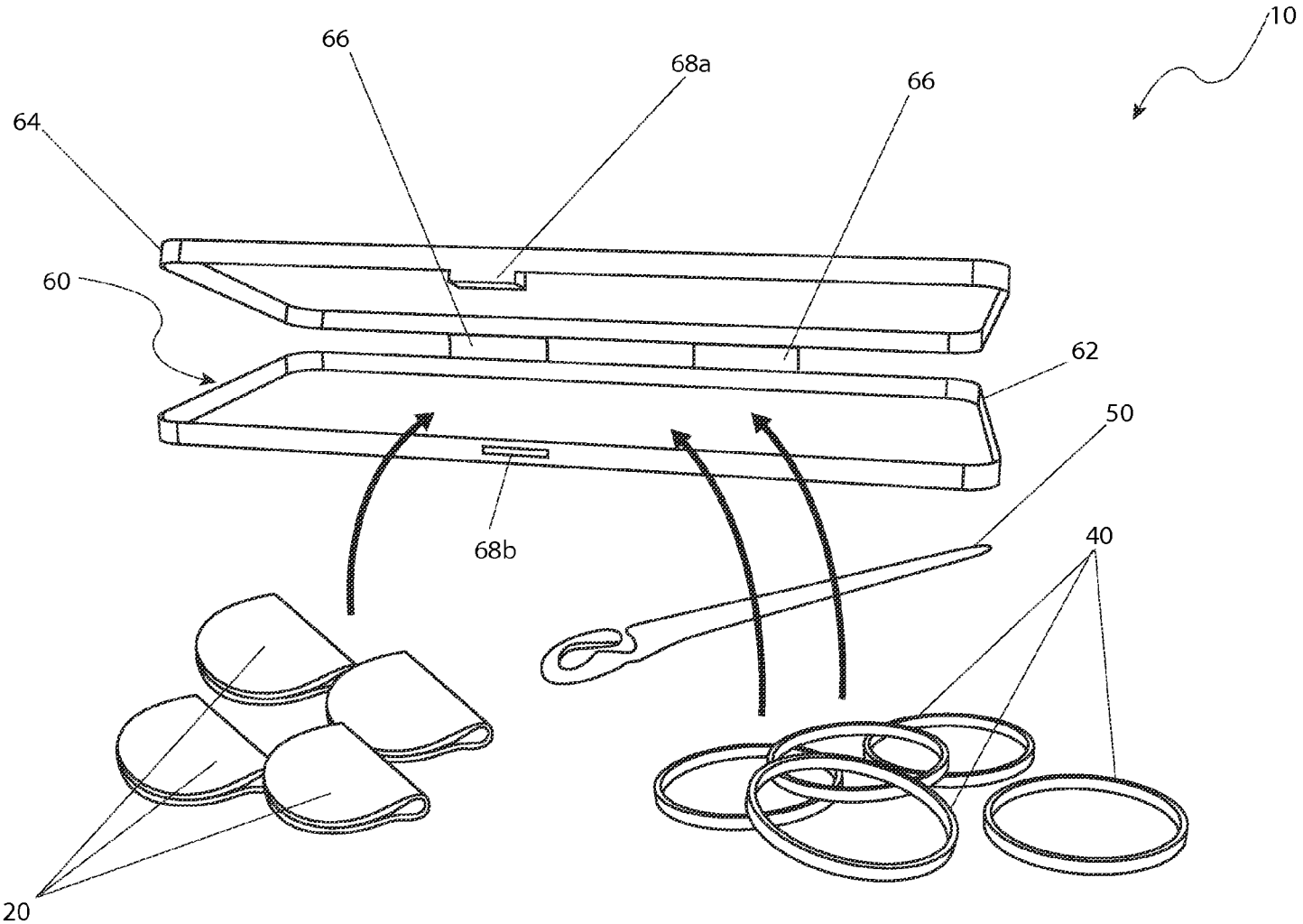

Referring now to FIG. 4, an exploded view of the system 10 depicting a kit form, according to a preferred embodiment of the present invention, is disclosed. The system 10 is envisioned to be provided with a molded plastic case 60 being made available in various attractive colors and patterns, and capable of discreetly containing a plurality of clips 20, a plurality of bands 40, and a needle 50. The case 60 provides a generally rectangular or ovular shape being foldable and lockable. The case 60 further comprises a bottom compartment 62 being suitable to hold the aforementioned portions, and an identically-shaped lid 64 being affixed to each other via at least one (1) integrally-molded second hinge 66 along a rear edge portion. The compartment 62 and lid 64 portions of the case 60 further comprise respective interlocking molded first and second latching features 68*a*, 68*b* along a front edge portion, which enable the case 60 to be stored securely in a closed state until needed. The case 60 is envisioned to be small enough to fit in a purse, in a desk at work, in a car glove box, or in a sewing box.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIGS. 2*a* and 2*b*.

The method of installing and utilizing the system 10 may be achieved by performing the following steps: procuring the system 10 in a kit form containing a desired number of clips 20 and bands 40; opening the case 60 and extracting a clip 20, a band 40, and a needle 50; positioning a perimeter portion of the band 40 within the first hinge portion 26 of the clip 20; inserting another perimeter portion of the band 40 into the side slot portion 52 of the needle 50; securing the band 40 within the side slot 52 by sliding the band 40 toward an adjacent end portion of the needle 50; placing the button 100 in a needed location upon the fabric 105; pushing the needle 50 and band 40 up through the fabric 105 and through an aperture 102 of the button 100; pulling the needle 50 and band 40 completely through the aperture 102 until the clip 20 is snug against the underside of the fabric 105; pushing the needle 50 down through an adjacent aperture 102 in the button 100; pulling the needle 50 and band 40 downward until the button 100 is tight against the fabric 105; inserting the forward perimeter portion of the band 40 into the first hinge portion 26 of the clip 20; locking the clip 20 in a closed state around the two (2) perimeter sections of the band 40 by engaging and snapping the male 28 and female 30 fastener portions of said clip 20 together; removing the needle 50 from the band 40 by extracting and detaching the band 40 from the side slot 52; repeating the above steps to attach additional buttons 100 to the fabric 105, as needed; and, benefiting from a portable and quick means of installing a button 100 upon a garment afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A button restraint system comprising:

at least one elastic band;

a needle, further comprising:

an eyelet portion located at a first end configured to retain an individual elastic band; and, a tapered configuration located at a second end; and, at least one clip, each having a first planar member affixed to a second planar member by a clip hinge, wherein said clip receives a portion of said individual elastic band within said first and second planar members.

2. The button restraint system recited in claim 1, wherein said eyelet portion further comprises:

an "S"-shaped aperture having a first end and a second end;

wherein said individual elastic band slidably inserts into said aperture through said first end;

wherein said "S"-shaped aperture is configured such that said first end grants access into said aperture from an exterior of said needle and said second end creates a burrow to retain said individual elastic band within said "S"-shaped aperture; and, wherein said individual elastic band slidably extracts from said second end and through said first end to remove said individual elastic band from said "S"-shaped aperture.

3. The button restraint system recited in claim 1, further comprising:

a clip fastener disposed on side surfaces of said first and second planar members to removably attach said first planar member to said second member, whereby placing an individual clip in a closed state; and, wherein said first planar member is folded on top of said second planar member with an individual elastic band inserted therein and secured in place via said clip fastener.

4. The button restraint system recited in claim 1, wherein said clip hinge comprises an integral tunnel-shaped extension of said first and second planar members.

5. The button restraint system recited in claim 4, wherein said integral tunnel-shaped extension is configured to provide clearance for an individual elastic band when an individual elastic band is inserted within an individual clip and said individual clip is placed in said closed state.

6. The button restraint system recited in claim 1, wherein said elastic band comprises a continuous circular band.

7. The button restraint system recited in claim 1:

wherein said first member exhibits a semi-circular shape;

wherein said second member exhibits a semi-circular shape; and, wherein each clip exhibits a clamshell configuration.

8. The button restraint system recited in claim 3, wherein said clip fastener comprises:

a first resilient spherical shaped member disposed on an inside surface of said first planar member;

a second resilient spherical shaped member disposed on an inside surface of said second planar member; and, wherein said first resilient spherical shaped member has an outer diameter slightly larger than an inner diameter of said second resilient spherical shaped member to enable an interference fit when said first resilient spherical shaped member is inserted into said second resilient spherical shaped member.

9. The button restraint system recited in claim 1, further comprising a case to contain and transport said needle, each elastic band, and each clip.

10. The button restraint system recited in claim 9, wherein said case further comprises:

a bottom compartment affixed to a top compartment via a case hinge; and, wherein said bottom compartment is configured to contain said needle, a plurality of bands, and a plurality of clips.

11. The button restraint system recited in claim 10, further comprising a case fastener disposed on side surfaces of said bottom compartment and said top compartment to removably secure said top compartment to said bottom compartment.

12. The button restraint system recited in claim 11, wherein said case fastener comprises:

a first latch disposed on a perimeter edge of said top compartment;

a second latch disposed on a perimeter edge of said bottom compartment; and, wherein said first and second latches interlock to create an interference fit when forced together, whereby maintaining said case in a shut state.

13. The button restraint system recited in claim 10, wherein said case hinge comprises:

a first integral semi-circular extension of a rear edge of said top compartment;

a second integral semi-circular extension of a rear edge of said bottom compartment; and, wherein said first and second extensions are configured to interconnect and enable swivel motion of said top compartment relative to said bottom compartment.

14. The button restraint system recited in claim 9, wherein said case has a rectangular shape.

15. The button restraint system recited in claim 9, wherein said case has an oval shape.

* * * * *